United States Patent [19]

Obidniak

[11] 4,101,032

[45] Jul. 18, 1978

[54] ORNAMENTAL ARTICLE FOR PACKAGES OR THE LIKE

[75] Inventor: Andy Obidniak, Ville la Salle, Canada

[73] Assignee: H & F Faller Sales Corp. Ltd., Montreal, Canada

[21] Appl. No.: 651,198

[22] Filed: Jan. 21, 1976

[30] Foreign Application Priority Data

Jan. 22, 1975 [CA] Canada ..... 218456

[51] Int. Cl.[2] ..... B65D 63/10

[52] U.S. Cl. ..... 206/457; 206/813; 229/8; 428/41; 428/40

[58] Field of Search ..... D19/13-16; 206/813, 457, 451; 229/8; 24/67 AR, DIG. 11, 17 A, 17 R, 16 R, 73 UA; 40/125 A, 10 R, 2 G; 248/DIG. 8; 428/40, 41; 46/156, 158

[56] References Cited

U.S. PATENT DOCUMENTS

| | | | |
|---|---|---|---|
| 1,676,835 | 7/1928 | Oberheu | 24/67 AR |
| 2,021,787 | 11/1935 | Janowitz | 24/17 A |
| 2,153,310 | 4/1939 | Newman | 24/67 R |
| 3,031,359 | 4/1962 | Blank et al. | 24/DIG. 11 |
| 3,507,416 | 4/1970 | Douglas et al. | 206/457 |
| 3,629,034 | 6/1977 | Kuroda | 428/914 |
| 3,677,250 | 7/1972 | Thomas | 24/67 AR |

OTHER PUBLICATIONS

Modern Packaging, p. 145, Apr. 1971.

*Primary Examiner*—George F. Lesmes
*Assistant Examiner*—Alexander S. Thomas

[57] ABSTRACT

The disclosure herein relates to an ornamental article to be affixed to a package which includes a flat blank formed of a pliable sheet material bearing on its outer surface a correspondingly-shaped fanciful printed character; the blank includes a central portion corresponding to the body of the character and two elongated narrow portions extending from opposite sides of the central portion, each side portion corresponding to the arm of the character and terminating at its extremity with a hand-shaped portion, the inner face of this hand-shaped portion including affixing means whereby the character blank may be applied by the hand portions to the package to create the visual impression of the character holding the package.

3 Claims, 4 Drawing Figures

ORNAMENTAL ARTICLE FOR PACKAGES OR THE LIKE

FIELD OF THE INVENTION

The present invention relates to an ornamental article for affixing to packages, parcels, gifts or the like.

OBJECT OF THE INVENTION

It is an object of the invention to provide a character-bearing blank which may be affixed to a package in order to create the visual impression that the character is holding the package, parcel, gift or the like.

STATEMENT OF THE INVENTION

The present invention therefore relates to an ornamental article which comprises a blank formed of pliable sheet material bearing on one face thereof a character having a central body portion and two elongated arm portions extending from the central body portion from opposite sides thereof; each elongated arm portion terminates at one end thereof with a portion representing one hand of the character; the inner face of each hand portion includes means for affixing the hand portions to the package with the arm portions in an outstretched position so as to create a visual impression of the character holding the package.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

DESCRIPTION OF PREFERRED EMBODIMENTS

Figure 1:
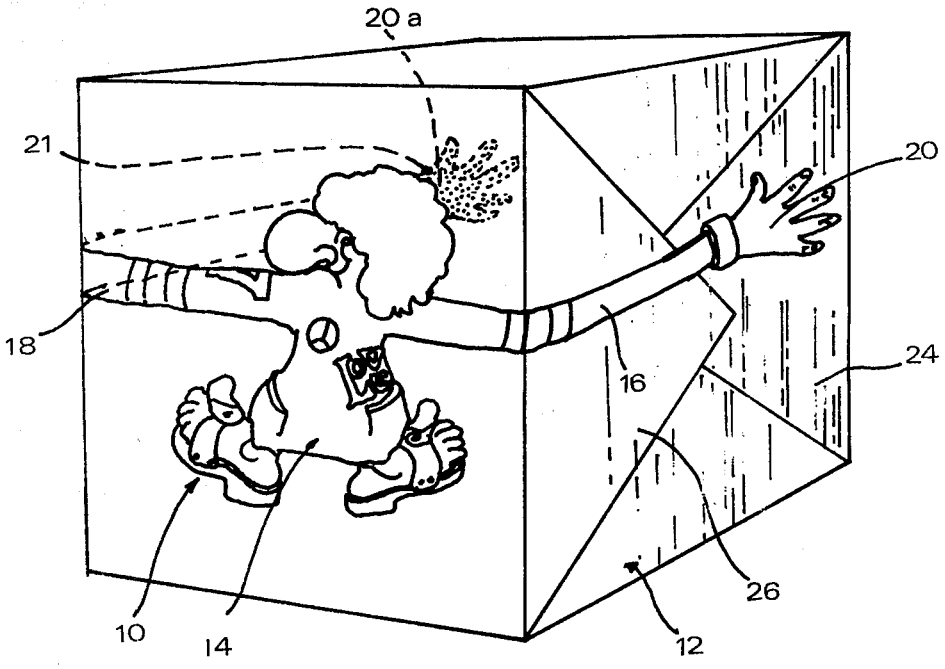
FIG. 1 is a front perspective view of a preferred embodiment of an ornamental article in accordance with the present invention affixed to a package.
Figure 2:
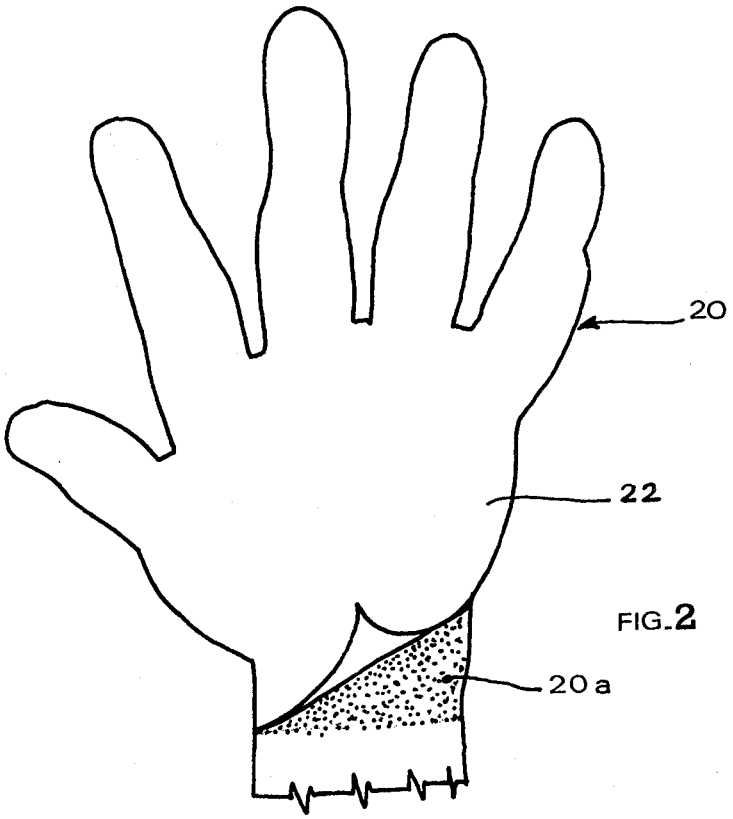
FIG. 2 is an enlarged view showing the inner face of a hand portion of the ornamental article.

Referring in detail to the drawings, a preferred embodiment of an ornamental article 10 is shown mounted to a wrapped object, such as a gift, parcel, package or the like.

The ornamental article 10 consists of a substantially flat cutout blank, formed of a pliable sheet material, which bears on its outer face a fanciful character. This blank which is correspondingly shaped to the character includes a central body portion 14 and two elongated narrow oversized or longer-than-normal arm portions 16 and 18, at each extremity of which there is provided a slightly enlarged portion 20, 21 representing the hand of the character. The inner face of each hand portion 20, 21 includes an adhesive layer 20*a*. Hand portion 20 is covered with a protective peelable backing sheet 22 which is similarly shaped and which is removed prior to affixing to a package. The fixing means may also consist of only a strip of adhesive extending in and/or adjacent the inner face of the hand portions.

To affix the ornamental article 10 to a parcel, package or gift, the central body portion 14 is applied against one side of the package and the arm portions 16 and 18 are completely outstretched; then, the backing sheet 22 is removed and hand portions 20, 21 are glued to the package. There results a visual impression that the character is holding the package.

The package shown in FIG. 1 is rectangular-shaped; however, it is evident that the ornamental article may be affixed to packages of any shapes and sizes. Further, the present ornamental article is not principally intended to secure a wrapping paper of a wrapped parcel; however, in the illustration of FIG. 1, the hand and arm portions cooperate to secure flaps 24 and 26 of the wrapper to one another, thereby avoiding the use of ribbons or other means of holding them together.

Figure 3:
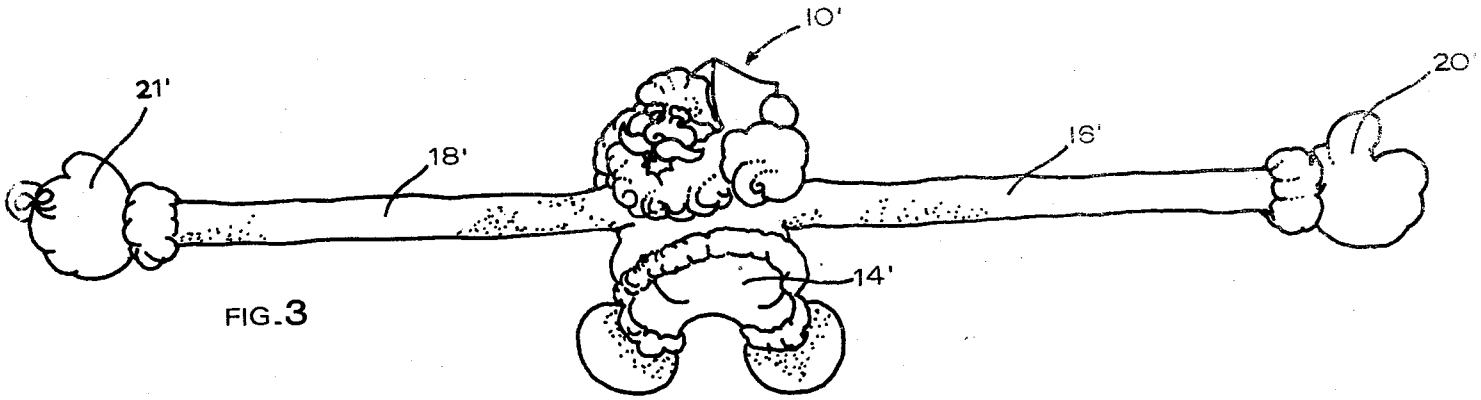
FIGS. 3 and 4 are other embodiments of an ornamental article made in accordance with the present invention.
Figure 4:
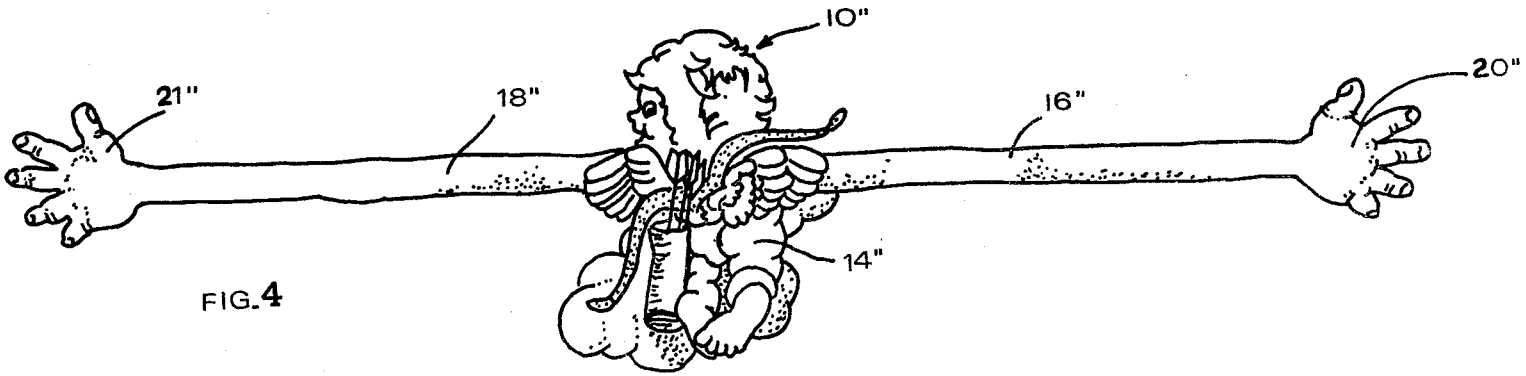

FIGS. 3 and 4 illustrate other characters which may be represented on other blanks 10', 10''. Structurally, these blanks include the same basic parts of the blank shown in FIG. 1, such as the central body portions 14', 14'', the elongated arm portions 16', 16'' and 18', 18'', and the hand portions 20', 20'' and 21', 21''. Although not shown, the inner face of these hand portions includes similar adhesive means as described above.

The pliable sheet of material of the blank consists of any flexible sheet, such as paper, cardboard or the like, having sufficient rigidity, however, that it will not tear easily.

Furthermore, a backing sheet would obviously not be necessary over those adhesive means which only need to be wet to adhere.

What is claimed is:

1. In combination with a three-dimensional package of predetermined size, an ornamental affixative article of size smaller than the package, said ornamental article comprising a blank of pliable sheet material a front and rear face and a shaped peripheral edge which outlines an animated character having a central body from each side of which extends a relatively narrow and elongated appendage of oversized arm length and terminating in enlarged hands, said blank having its front face provided with indicia representative of said animated character and its rear face at least in the region of said hands provided with the adhesive for affixing the animated character to said package, said blank being fitted snugly against said package with its rear face in contact with the surface thereof and with the body portion and the oversized arm lengths fully extended to envelope the package along at least two of its surfaces.

2. The combination of claim 1, wherein the package is rectangular in section and has four side walls and a top and a bottom wall, said body of the animated character being disposed on one of the side walls with the arms extending from said body partially in the plane of said one wall and partially in the plane of said top and bottom walls perpendicularly to said one wall.

3. The combination of claim 2, wherein the package has a wrapping with closure flaps at the top and bottom wall, said hands being affixed with said adhesive to said top and bottom walls over said flaps to prevent said flaps from accidentally opening.

* * * * *